United States Patent [19]

Stuart

[11] Patent Number: 4,841,839

[45] Date of Patent: Jun. 27, 1989

[54] RECOIL ABSORBING GUN MOUNT DEVICE

[76] Inventor: Richard K. Stuart, Easley, S.C. 29640

[21] Appl. No.: 79,818

[22] Filed: Jul. 30, 1987

[51] Int. Cl.[4] ..... F41D 11/24

[52] U.S. Cl. ..... 89/37.04; 269/220; 42/94

[58] Field of Search ..... 89/37.04; 42/94; 211/64; 269/219, 220, 240, 258

[56] References Cited

U.S. PATENT DOCUMENTS

| | | | |
|---|---|---|---|
| 125,743 | 4/1872 | Lehnert | 89/37.04 |
| 2,427,365 | 9/1947 | Meister | 89/37.04 |
| 2,729,975 | 1/1956 | Hawthorne et al. | 89/37.04 |
| 2,870,683 | 1/1959 | Wilson | 42/94 |
| 3,358,504 | 12/1967 | Freebairn | 89/37.04 |
| 3,473,673 | 10/1969 | Porter | 211/64 |
| 3,621,597 | 11/1971 | Price | 42/94 |
| 4,226,399 | 10/1980 | Henderson | 211/64 |
| 4,449,314 | 5/1984 | Sorensen | 42/94 |
| 4,548,392 | 10/1985 | Rickling | 269/296 |
| 4,621,563 | 11/1986 | Poiencot | 89/37.04 |

*Primary Examiner*—Deborah L. Kyle
*Assistant Examiner*—Daniel Wasil
*Attorney, Agent, or Firm*—Cort Flint

[57] ABSTRACT

A recoil absorbing gun mount (A) is disclosed which includes an elongated base (20) with a widened stabilized front end (22). A rear (24) of the base is supported by an incline adjusting leg (30) adjusted by a star wheel (32). Clamping jaws (40, 42) carry resilient gripping pads (44, 46) to frictionally clamp a gun (10) in the mount. The clamping jaws are attached by means of a pivot (C) which allows the clamping jaws to pivot in a yaw direction (56) and a roll direction (58). The pivotal movement in two degrees of freedom allows a clamping space (48) to be adjusted to accommodate different shapes and sizes of guns. The pivot includes angled slots (40*f*, 42*f*) formed in clamping jaws (40, 42). These angled slots slide over an operator rod (60) so that jaws (40, 42) may pivot relative to the base. A reduced clamping force is applied at (66) which is reduced from the force applied by operator rod (60). Pivot (C) is further enhanced by a major clearance (54) between vertical slots (40*e*, 42*e*) formed in the clamping jaws and a raised land (50, 52) carried on the base which allow for the yaw motion between the jaws.

34 Claims, 3 Drawing Sheets

Fig. 3.
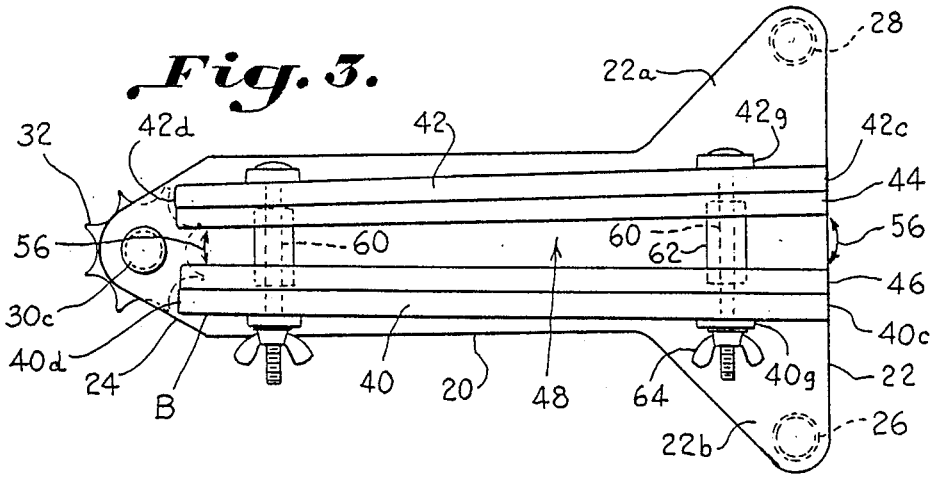
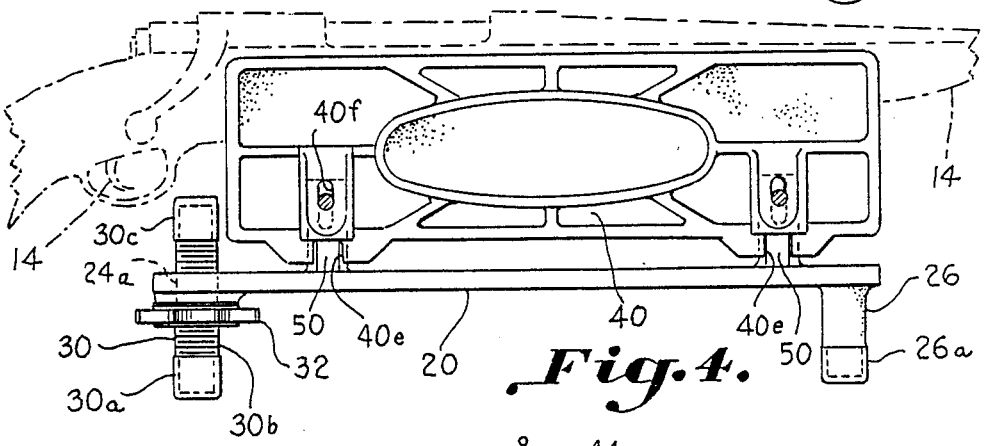
Fig. 4.
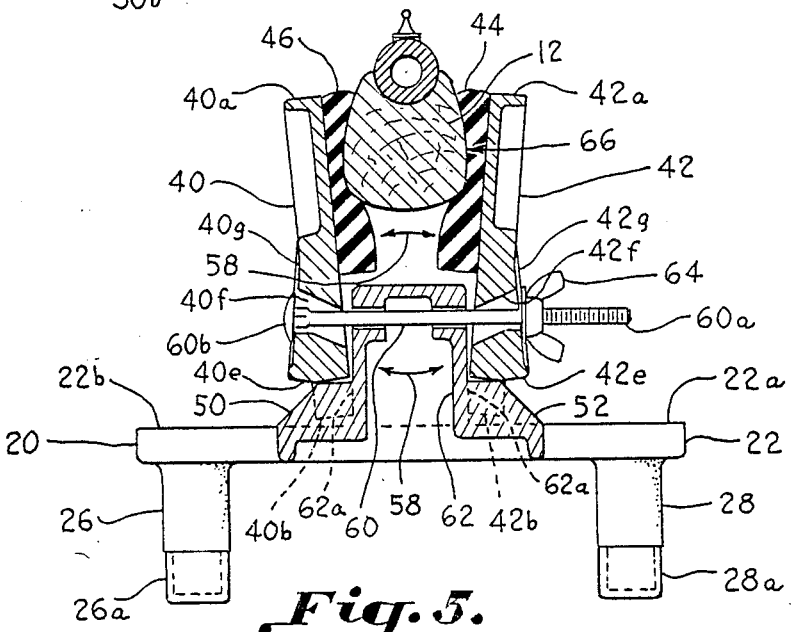
Fig. 5.

RECOIL ABSORBING GUN MOUNT DEVICE

BACKGROUND OF THE INVENTION

With the increased popularity of hunting, particularly for large game animals, there has been a corresponding increase in the use of high powered rifles. Typically the high powered rifle will include a telescopic sight. The sight needs to be in precise alignment with the gun barrel for accuracy in hitting the animal or other target. The increasing use of high powered rifles has also been followed with an increasing need for target practice. The problem arises that the high powered rifle has considerable recoil. Repeated firing of a rifle in a short length of time as required for target practice and gun sight alignment is not always desirable due to the large recoil.

Prior attempts have been made to provide a mount for a gun or high powered rifle to absorb recoil. U.S. Pat. No. 4,621,563 discloses an apparatus for aligning a gun sight which includes a gun receiving member which pivots relative to a base. A spring is fixed between the gun receiving member and the base for absorbing horizontal and vertical components of recoil when the gun is fired. The device provides gripping of the gun over very little of its surface and relies upon the gun being cradled within the gun receiving member for recoil absorption through a spring. Access to the butt end is prohibited with the gun received in the gun receiving member. Firing of the gun in a natural position with the butt against the shoulder is not possible. This renders the device not entirely satisfactory for practicing during target shooting or gun sight alignment. U.S. Pat. No. 2,729,975 discloses another recoil mount for a high powered rifle. Once again the device is relatively complicated and does not allow for shooting the gun in a natural position with the butt against the shoulder. U.S. Pat. No. 125,743 discloses a stand for testing fire arms in which a barrel of the gun is clamped between clamping members at a fore end. This allows the gun to be shot in a more natural position against the shoulder. However, the device is not entirely satisfactory for absorbing recoil, particularly from the modern day high powered rifle.

Accordingly, an object of the invention is to provide a recoil absorbing gun mount which is simple in construction and use and yet reliably grips a gun for recoiled absorption during testing and target practice.

Still another object of the invention is to provide a simple and effective recoil absorbing gun mount which is small and portable.

Another object of the invention is to provide a small portable recoil absorbing gun mount which clamps a high powered rifle in a secure clamping position for absorbing recoil in a manner that the rifle may be fired in a natural position abutting the shoulder of the gunner.

Another object of the invention is to provide a recoil absorbing gun mount which will reliably clamp a wide variety of gun shapes and sizes for absorbing recoil when the gun is mounted and fired.

SUMMARY OF THE INVENTION

The above objectives are accomplished according to the invention by providing a gun mount device for absorbing recoil from a gun mounted and fired on the device which includes an elongated base having a front and a rear end. A pair of elongated clamping jaws are carried by the elongated base which have upper and lower edges. The clamping jaws have front and rear edges. A friction gripping material is carried adjacent the upper edges of the clamping jaws for frictionally gripping a portion of the gun along its length. A pivot carries the clamping jaws on the base in a manner that the lower edges of the jaws move in translation and in pivotal roll motion. The front and rear edges of the clamping jaws move independently of each other in a pivotal yaw motion so the ends of the clamping jaws may be made to converge or diverge. In this way, a wide variety of shapes and sizes of gun stocks may be effectively clamped for recoil absorption. A clamp operator applies a clamping force to the clamping jaws which moves them towards each other. The base and clamping jaws have a sufficient mass so that recoil from the gun frictionally gripped in the jaws is effectively absorbed by the device when fired.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3 is a top plan view of a recoil absorbing gun mount according to the invention;

FIG. 4 is a side elevation of a recoil absorbing gun mount frictionally clamping a gun according to the invention;

FIG. 5 is a sectional view taken along line 5—5 of FIG. 1;

DESCRIPTION OF A PREFERRED EMBODIMENT

Figure 1:
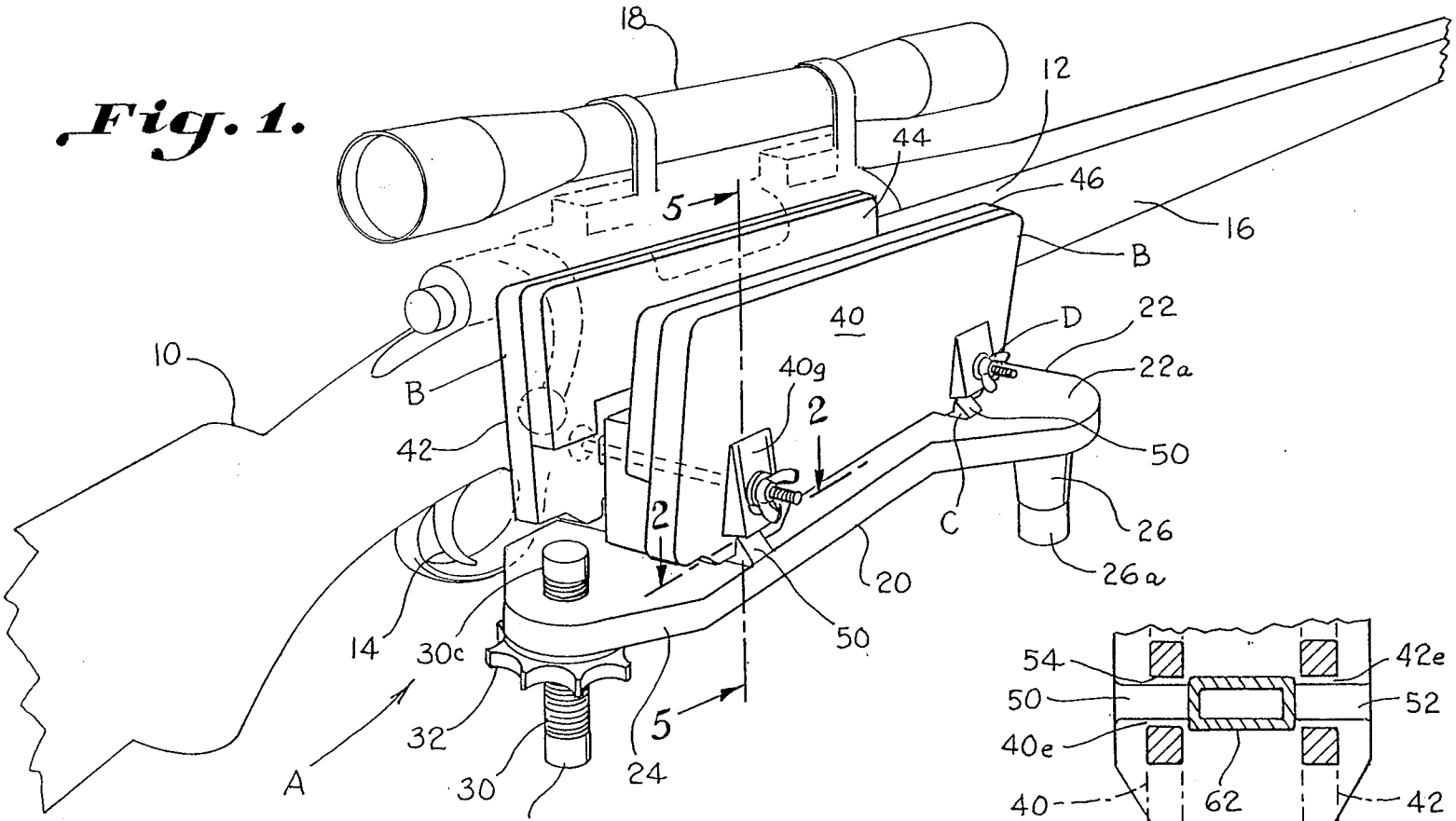
FIG. 1 is a perspective view of a recoil absorbing gun mount according to the invention.

Referring now in more detail to the drawings, as can best be seen in FIG. 1, a gun mount device designated generally as A is provided for mounting a gun such as a high powered rifle 10. The term gun means a rifle, shotgun, hand gun, or any other fire arm. While the gun mount of the present invention may frictionally clamp guns and like articles, and absorb any recoil from any type gun, the mount has particular advantages for a high powered rifle. Accordingly, the invention will be described in connection with a high powered rifle while it is understood that the mount may be used for mounting any gun. The mount may clamp any portion of the gun as desired for firing. However, it is most advantageous that the mount be used to clamp a portion of the gun stock 12 of rifle 10 as can best be seen in FIGS. 1 and 4. The term gun stock is to be read as any portion of the gun desired for clamping. In this position, gun 10 has the trigger 14 in firing position. The gunner may quite naturally place the butt of the gun against his shoulder in a natural firing position. The other hand of the gunner may then grip the fore end 16 of the rifle. While not illustrated, the barrel of a gun may also be effectively clamped by the gun mount of the invention.

Referring now in more detail to the gun mount, the gun mount includes an elongated base 20 having a front end 22 and a rear end 24. Front end 22 is advantageously widened. This acts to stabilize the base for recoil absorption. Widened front end 22 carries two depending legs 26 and 28 with rubber tips 26*a* and 28*a*. As can best be seen in FIGS. 3 and 7, front end 22 includes side projections 22*a* and 22*b*. Legs 26 and 28 are spread apart giving the base a wide foundation at the front end for stabilization. At rear end 24, a third depending leg 30 has a rubber tip 30*a*. Threads 30*b* are provided on the leg for mating with a star wheel 32. Leg 30 extends loosely through an unthreaded opening 24*a* in the rear 24 of the base. Leg 30 threadably mates with star wheel 32 to provide a means for varying the inclination of the base of sighting the gun on target. Leg 30 is free in the opening 24*a*, but the base abuts atop the star wheel. A top cap 30*c* prevents leg 30 from falling out of opening 24*a*. As wheel 32 is turned and run upwardly on the leg, the rear 24 of the base is raised. Now the advantage of clamping the gun into the position shown in FIG. 4 can best be understood. With the finger on trigger 14, the hand may easily finger the star wheel 32 to raise and lower the rear of the base for sighting the gun on target. An advantageous base platform is provided which is very stable, yet simply and effectively provides for varying the inclination of the base and the gun mounted. The rubber tips of the three depending legs further facilitate recoil absorption by frictionally and resiliently gripping a surface such as a table top on which the gun mount is placed.

Clamping means B includes a pair of clamping members in the form of spaced clamping jaws 40 and 42 pivotally carried on base 20. The clamping jaws have upper free edge portions 40*a* and 42*a*, and lower free edge portions 40*b* and 42*b*. Clamping jaws have front free edge portions 40*c* and 42c and rear free edge portions 40*d* and 42*d*. Clamping jaws 40 and 42 are elongated to clamp a length of the gun such as the gun stock forward of the trigger. A layer of friction material 44 and 46 are carried by the clamping jaws 40 and 42. Any suitable friction material such as rubber, polyurethane, etc., having a high coefficient of friction for gripping the gun may be used. Elongated base 20 and clamping jaws 40 and 42 are preferably constructed from aluminum or other heavy material having a sufficient mass to absorb the recoil of gun 10 through friction material 44 and 46. As can best be seen in FIG. 3, a clamping space 48 is defined between opposing clamping jaws 40 and 42 which may be varied in its cross-section from front to rear and top to bottom as will now be fully explained.

Pivot means C for allowing clamping jaws 40 and 42 to move and pivot in two degrees of freedom is provided. Pivot means C includes a pair of vertical slots 40*e* formed in jaw 40 and like vertical slots 42*e* formed in jaw 42. These slots are open at the lowermost ends of the jaws. Vertical slots 40*e* of clamping jaw 40 are carried over spaced raised land 50 carried by base 20. Vertical slots 42*e* of jaw 42 are carried over spaced raised lands 52 on the opposing side of the base. As can best be seen in FIG. 2, there is a major clearance 54 between the vertical slots 40*e* and 42*e* and the lands 50 and 52. Lower edges 40*b*, 42*b* of the clamping jaws are free and not fixed to a pivot at base 20. Clearance 54 provides a loose fit between the slots and the land so that clamping jaws 40 and 42 may pivot in two directions of freedom. First about a roll axis in a roll direction, and second about a yaw axis in a yaw direction. The front and rear ends of the jaws may move in a yaw direction indicated by arrows 56. Similarly, the upper and lowermost edges move freely so clamping jaws 40 and 42 may pivot in a roll direction as indicated by arrows 58. This is important because it allows the clamping jaws to converge or diverge toward the front or rear of the base and at the same time the upper and lower free edge portions of the clamping jaws may pivot either in or out. This provides for pivotal movement in two degrees of freedom to adjust clamping space 48 to clamp a wide variety of gun shapes and sizes, and portions of the gun such as the stocks, barrels, etc. Lands 50, 52 and slots 40*e*, 42*e* provide guide means for guiding the clamping jaws in this pivotal motion.

Clamp operating means D is provided for applying a clamping force to the clamping jaws 40 and 42. The clamp operating means includes angled slots 40*f* and 42*f* formed in clamping jaws 40 and 42, respectively. The angled slots allow the plates to pivot about an operator rod 60 which provides an actuation means for applying a clamping force. Operator rod 60 extends through the angled slots and through a spacer block 62 which is between clamping jaws 40 and 42. As illustrated, operator rod 60 is a threaded rod with a wing nut 64 attached to a threaded end 60*a*. Rod head 60*b* abuts an inclined cam 40*g* and wing nut 64 abuts a corresponding inclined cam 42*g*. Slots 40*f* and 42*f* are angled at about 30 degrees to a horizontal. Cams 40*g* and 42*g* form about a 10 degree angle with a vertical. This combination provides a desired clamping force and pivotal movement.

Figure 2:
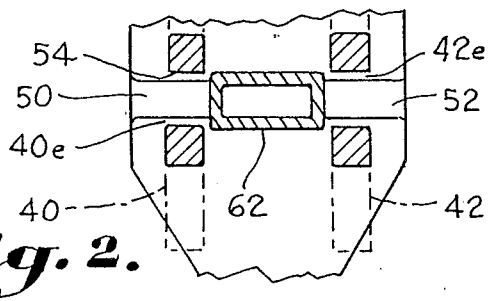
FIG. 2 is a sectional view taken along line 2—2 of FIG. 1.
Figure 6:
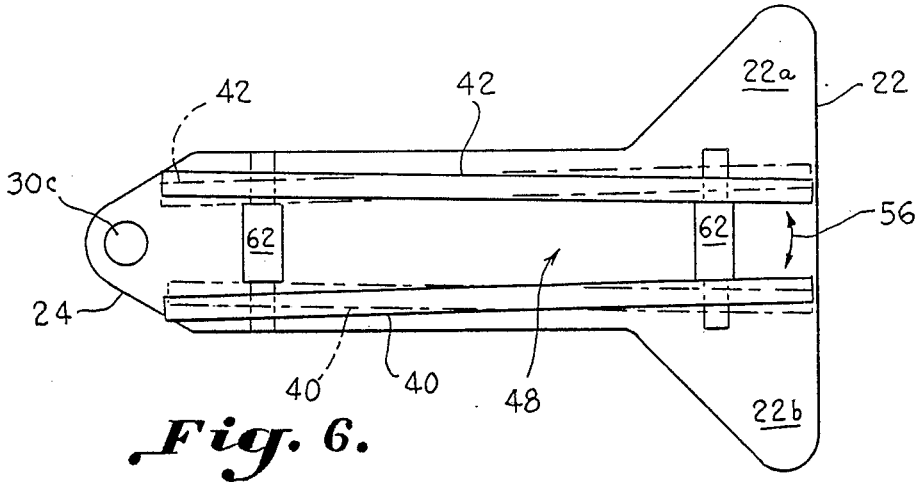
FIG. 6 is a schematic illustration illustrating the movement of a pair of clamping jaws carried for pivotal motion in a yaw direction according to the invention.

As can best be seen in FIGS. 2 and 5, spacer block 62 provides an abutment at 62*a* for the lowermost edge portions 40*b* and 42*b* of the clamping jaws. This abutment occurs as edge portions 40*b* and 42*b* first move in translational motion as wing nut 64 is tightened on bolt 60. After reaching the abutment 62*a*, the lower edges of the clamping jaws are fixed in abutment and the clamping jaws then begin to pivot inwardly to clamp gun stock 12. For adjustability, it may also be that for a widened gun stock, that the lowermost edge portions 42*b* and 40*b* not abut spacer block 62, but remain at a distance therefrom. Angled slots 40*f* and 42*f* allow clamping plates 40 and 42 to pivot about the base and slide and pivot over operator rod 60. Clearance 54 also allows jaws 40, 42 to pivot about base 20 in the yaw direction about an imaginary yaw axis, without striking abutment 62*a*. Clamp operating means E works at two longitudinally spaced points established at the two slots 40*e*, 40*f* and two rods 60. As can best be seen in FIGS. 3 and 4, these two spaced operators are located at the pivot guides and apply the clamping force at longitudinally spaced points that facilitates pivotal movements in opposite yaw directions. This also allows the yaws to converge or diverge to either end.

Figure 7:
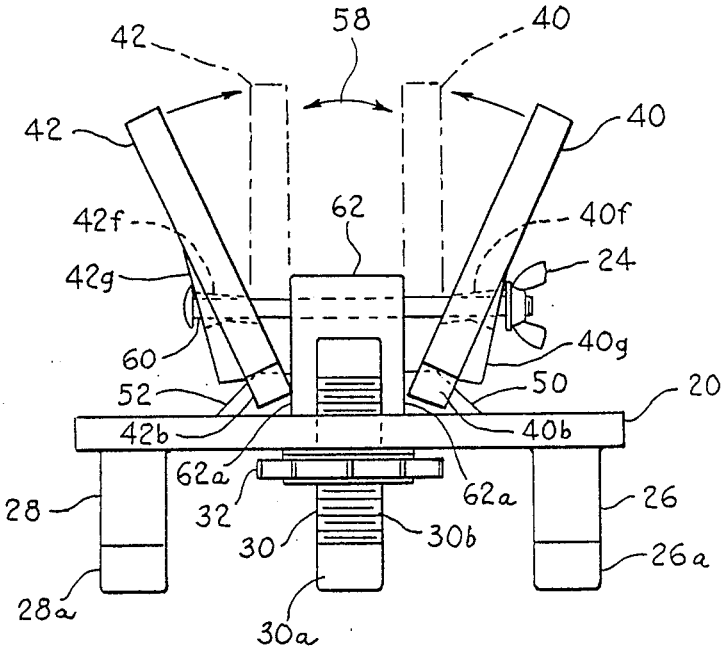
FIG. 7 is a rear elevation of a recoil absorbing gun mount illustrating a pair of clamping jaws carried for pivotal movement in a roll direction.

As can best be seen in FIGS. 5 and 7, by locating operator rod 60 and wing nut 64 as shown, a reduced graduated clamping force is applied at a clamping region shown generally at 66. Since this gripping region is about ½ the distance between the application point of a main clamping force and the upper edges of the clamping jaws, a reduced gripping force of about ½ the main clamping force will be applied at clamping region 66 which is graduated from the application point. This is important for several reasons. Portions of the wooden stock of the gun adjacent the clamped area are often hollow. The wooden stock is a very expensive part of the gun. If too much clamping force is applied to the wooden gun stock, splitting of the wood gun stock may occur, particularly through the hollow areas. The reduced clamping force reduces the chances that the gun may be damaged by excessive clamping force.

While a preferred embodiment of the invention has been described using specific terms, such description is for illustrative purposes only, and it is to be understood that changes and variations may be made without departing from the spirit or scope of the following claims.

What is claimed is:

1. A gun mount device for absorbing the recoil from a gun mounted and fired on said device comprising:

(a) a base for providing a support on a surface having a front and a rear;

(b) a pair of clamping members carried by said base having upper and lower generally free edge portions and front and rear ends;

(c) a clamping space defined between said clamping members;

(d) friction gripping means carried adjacent said upper free edge portions of said clamping members for frictionally gripping a gun stock of said gun along a length of said gun stock;

(e) pivot means for carrying said clamping members on said base in a manner that said lower edge portions may move in pivotal and translational motions and said front and rear ends may move independently so that said clamping members may converge or diverge from the rear to the front of the base;

(f) clamp operating means for applying a clamping force to said clamping members urging said clamping members towards each other; and (g) said base and clamping members effectively absorbing the recoil from said gun when said gun stock is frictionally clamped by said clamping members during firing.

2. The device of claim 1, wherein said pivot means moves said lower free edge portions of said clamping members in translational motion until a prescribed distance is reached between said lower free edge portions and thereafter said clamping members pivot about said lower free edge portions as said clamping members frictionally grip said gun stock.

3. The device of claim 1, wherein said clamp operating means includes actuation means for directly applying a clamping force to said clamping members intermediate said upper and lower free edge portions which produces a reduced clamping force applied to said gun stock, said reduced force being less than the clamping force directly applied by said actuation means.

4. The device of claim 1, wherein said pivot means includes guide means for carrying said clamping members on said base in pivotal movements in a yaw direction so that said members may converge or diverge to either said front or rear of said base.

5. The device of claim 4, wherein said guide means carries said clamping members on said base for pivotal motion of a roll direction in which said lower edge portions of said clamping members are free to move in translational motion.

6. The device of claim 1, wherein said clamp operating means includes an actuation means for applying a clamping force to said clamping members at a plurality of longitudinally spaced points along a length of said members.

7. The device of claim 1, wherein said pivot means includes bi-directional guide means carried by said base and clamping members for guiding said clamping members in said translational and pivotal motions; and actuation means for applying a clamping force urging said clamping members together.

8. The device of claim 7, wherein said guide means comprises vertical slots carried by said clamping members; and lands carried raised above said base generally fitting within said slots to guide said plate members in said translational and pivotal motions.

9. The device of claim 8 including a spacer blocks carried by said base between said clamping members, said raised lands terminating adjacent opposing sides of said blocks, and said lower free edge portions of said clamping members abutting said block during said pivotal motion.

10. The device of claim 1, wherein said clamp operating means comprises a pair of angled slots extending through said clamping members angled in a direction for pivotal movement, and operator means extending through said angled slots connecting said members together to pivot and urge them towards each other as said operator means is manually operated.

11. The device of claim 9, wherein said angled slots are inclined at pre-described angles with respect to said clamping members and said operator means comprises a operator rod extending through said slots and connected to said clamping members in such a manner that said clamping members may pivot inwardly as they slide axially along said rod towards each other under said clamping force.

12. The device of claim 10, wherein said angled slots form an angle of about 30 degrees with the horizontal.

13. The device of claim 1, wherein said base comprises inclination adjustment means for adjusting the inclination of said base relative to said surface.

14. The device of claim 13, wherein base includes a plurality of supporting said base upon said surface legs having an outer covering of resilient material for gripping said surface to further facilitate recoil absorption.

15. The device of claim 9 including an inclined cam carried by an outer surface of said clamping members which is engaged by said operator rod to urge said clamping members together.

16. The device of claim 9, wherein said inclined cams form an angle of about 10 degrees with a vertical.

17. The device of claim 1, wherein said base includes a front which is widened with respect to a rear portion of said base for lateral stabilization.

18. A gun mount device for clamping and mounting a gun and the like, and for absorbing the recoil from a gun fired and mounted on said device comprising:

(a) a base for providing a support on a surface having a front and rear;

(b) elongated clamping means carried by said base for frictionally gripping a gun stock and the like of said gun along a length of said gun;

(c) an adjustable clamping space defined by said elongated clamping means having an adjustable width; and (d) clamp operating means carried by said base for moving said elongated clamping means relative to said base in a manner that said clamping space may be tapered toward the front or toward said rear of said base for gripping a variety of gun stock shapes and sizes; and said clamp operating means moving said elongated clamping means in a manner that the width of said gripping space is closed upon said gun whether said space is tapered toward either said rear or front to frictionally grip said gun so that said device effectively absorbs said recoil.

19. The device of claim 17 including actuation means for applying a main clamping force to said clamping means in producing a reduced clamping force on said gun stock by said clamping means, said reduced force being reduced from said main clamping force to prevent damage to said gun.

20. The device of claim 18, wherein said support comprises means for adjusting the inclination of said base relative to said surface.

21. The device of claim 18, wherein said adjustable clamping space is defined by elongated clamping means carried on said base for pivotal movement in a yaw and roll direction in such a manner that said clamping means may converge towards the front of said device or towards the rear of said device and may converge outwardly from said base or diverge toward said base.

22. A gun mount device clamping and mounting a gun and the like, and for absorbing the recoil from a gun mounted and fired in said device comprising:

(a) a base for providing a support on a surface;

(b) a pair of elongated clamping jaws carried by said base for frictionally gripping said gun along a length of said gun;

(c) pivot means for mounting said elongated clamping jaws on said base in a manner that lower free edge portions of said clamping jaws move freely in translational motion;

(d) said lower free edge portions of said clamping jaws being carried by said base in a manner that the distance between said edge portions may change as said clamping jaws pivot towards each other; and (e) clamp operating means for urging said clamping jaws towards each other into a clamping relationship with said gun placed between said clamping jaws so that said device effectively absorbs said recoil; and (f) said pivot means including an abutment means carried by said base toward which said clamping jaws rotate when urged together by said clamp means and said lower edge portions move in translational motion until engaging said abutment means and thereafter pivot about said abutment means.

23. The device of claim 22, wherein said pivot means comprises:

(a) a plurality of vertical slots formed in said clamping jaws;

(b) raised lands carried by said base; and (c) said vertical slots being received over said lands to guide and clamping jaws in pivotal and translational motions.

24. The device of claim 23, wherein said clamp operating means comprises a pair of angled slots formed in said clamping jaws; an operator rod extending through said slots in a manner that clamping jaws pivot as said rod moves in said angled slots; and said operator rod includes actuation means for causing said clamping jaws to slide over said rod and pivot towards each other into a clamping position.

25. The device of claim 23 including a clearance between said vertical slots and said lands allowing said clamping jaws to be received on said lands and pivot in a yaw direction to converge towards the front of said device or alternately converge to the rear of said device.

26. The device of claim 22 including a resilient elongated gripping strip carried adjacent said upper free edge portion of said clamping jaws for resiliently gripping said gun stock.

27. The device of claim 22, wherein said clamp operating means applies a main clamping force intermediate said upper and lower free edge portions in a manner that a reduced clamping force reduced from said main clamping force is applied to said gun by said clamping jaws.

28. A gun mount device for absorbing the recoil from a gun mounted and fired on said device comprising:

(a) a base for providing a support on a surface having a front and a rear;

(b) elongated clamping means for clamping a gun to said device;

(c) pivot means for carrying said elongated clamping means on said base for individual pivotal movements in yaw and roll directions so that said elongated clamping means adjusts in independent movements in said yaw and roll directions to reliably clamp guns of different sizes and shapes; and (d) clamp operating means for applying a clamping force to said clamping means to clamp said gun within said clamping means so that said device effectively absorbs said recoil.

29. The device of claim 28, wherein said clamp operating means includes an actuating means for applying a clamping force to said clamping jaws at a plurality of longitudinally spaced points on the length of said clamping means.

30. The device of claim 28, wherein said clamping means comprises a pair of elongated clamping jaws; and said clamp operating means comprises angled slots formed in said clamping jaws; and an operator rod extending through said angled slots to urge said clamping jaws together in a pivotal movement in said roll direction.

31. The device of claim 30, wherein said clamping jaws include lower free edges which are generally free to move in translational motion.

32. The device of claim 28 wherein, said clamp operating means comprises actuation means for applying a main clamping force to said clamping means in a manner than said gun is clamped with a reduced force which is reduced from said main clamping force.

33. The device of claim 32, wherein said main clamping force is applied at two longitudinally spaced points along a length of said clamping jaws.

34. The device of claim 33 including spaced pivot means connecting said clamping jaws relative to said base arranged generally at said points of main clamping force application.

* * * * *